US008359775B2

(12) United States Patent
Mothaffar

(10) Patent No.: US 8,359,775 B2
(45) Date of Patent: Jan. 29, 2013

(54) MULTI-PURPOSE CARRY-ON MOBILE DEVICE WITH L.E.D. FLASH LIGHTS ALERT

(76) Inventor: Hussain Y. A. M. Mothaffar, Salmiya (KW)

( * ) Notice: Subject to any disclaimer, the term of this patent is extended or adjusted under 35 U.S.C. 154(b) by 0 days.

(21) Appl. No.: 13/024,436

(22) Filed: Feb. 10, 2011

(65) Prior Publication Data

US 2012/0204455 A1 Aug. 16, 2012

(51) Int. Cl.
*G09F 15/00* (2006.01)

(52) U.S. Cl. ..... 40/610; 40/612

(58) Field of Classification Search ..... 40/610, 40/612; 248/461–465
See application file for complete search history.

(56) References Cited

U.S. PATENT DOCUMENTS

| | | | | | |
|---|---|---|---|---|---|
| 179,134 | A * | 6/1876 | Rand | 248/461 |
| 515,649 | A * | 2/1894 | Brookmire, Jr. | 248/461 |
| 765,187 | A * | 7/1904 | Meyer et al. | 248/461 |
| 959,044 | A * | 5/1910 | Barnes | 248/461 |
| 1,364,169 | A * | 1/1921 | Wolff | 248/461 |
| 1,368,317 | A * | 2/1921 | Zondlo | 248/461 |
| 1,812,171 | A * | 6/1931 | Rice | 40/515 |
| 2,156,489 | A * | 5/1939 | Bonetti | 248/461 |
| 2,481,264 | A * | 9/1949 | Tulowiecki | 248/461 |
| 3,031,247 | A * | 4/1962 | Schieve | 312/231 |
| 3,200,786 | A | 8/1965 | Swezy et al. | |
| 3,526,200 | A | 9/1970 | Doyle | |
| 4,305,062 | A | 12/1981 | Hogg, Jr. et al. | |
| 4,888,894 | A | 12/1989 | Brown, Jr. | |
| 5,472,162 | A | 12/1995 | Mason | |
| 5,617,075 | A | 4/1997 | Worth et al. | |
| 5,713,553 | A * | 2/1998 | Cooper | 248/461 |
| 6,264,161 | B1 * | 7/2001 | Waggoner | 248/460 |
| 6,293,511 | B1 * | 9/2001 | Shepherd | 248/441.1 |
| 6,322,230 | B1 | 11/2001 | Medici | |
| 7,040,777 | B2 | 5/2006 | Yuen | |
| 7,356,950 | B1 * | 4/2008 | Avery | 40/124.02 |

* cited by examiner

*Primary Examiner* — Casandra Davis
(74) *Attorney, Agent, or Firm* — Richard C. Litman

(57) ABSTRACT

The present invention provides a portable multi-purpose sign and device having a housing with a proximal end and a distal end, a support member positioned on one side of the housing, a collapsible tripod assembly pivotally attached to the proximal end of the housing, a cover having substantially the same shape and configuration as the housing and pivotally attached to the proximal end, and a removable display device removably mounted on the support member and stored between the housing and the cover in a collapsed configuration. The collapsible tripod assembly further includes a plurality of leg extensions pivotally attached one to another and nestable within one another in a collapsed configuration to house within the housing.

8 Claims, 7 Drawing Sheets

MULTI-PURPOSE CARRY-ON MOBILE DEVICE WITH L.E.D. FLASH LIGHTS ALERT

TECHNICAL FIELD

The present invention is generally directed toward a portable sign, and more particularly, to a collapsible and portable multi-purpose sign and device.

BACKGROUND OF THE INVENTION

Many prior art collapsible and portable signs have been developed in recent years. Although collapsible, many of these signs are not easily collapsed and folded for storing and carrying purposes, and further require substantial assembly and a separate case or housing for carrying them to a desired site.

For example, U.S. Pat. No. 3,200,786, issued to Swezy et al., discloses a collapsible three-legged sign for use on highways, in which the display sign component can only be rolled up.

Another approach is disclosed in U.S. Pat. No. 3,526,200, issued to Doyle, in which a collapsible sign is mounted on four arms, and the collapsible sign further includes a plurality of warning flags extending from a support pole.

Yet a further recent approach is disclosed in U.S. Pat. No. 4,888,894, to Brown, Jr., in which a sign stand for supporting highway safety signs is disclosed having a plurality of folding legs which support the sign stand on the ground or a support surface.

One of the disadvantages associated with these prior art collapsible signs is the lack of an integral carrying case and the manner in which they can be easily folded and carried within the case, as well as lack of means for allowing the sign to be used effectively in the dark.

It is therefore a primary object of the present invention to provide a collapsible and portable sign with a light emitting means, portable sign which can be easily folded, and an integral carrying case for storing and carrying the collapsed and folded sign.

Notwithstanding the above, it is presently believed that there may be a significant demand in the marketplace for a collapsible and portable sign and device with an integral carrying case having the above-stated features of the present invention.

BRIEF SUMMARY OF THE INVENTION

These problems and others are addressed by the present invention which comprises a portable multi-purpose sign and device having a housing with a proximal end and a distal end, a support member positioned on one side of the housing, a collapsible tripod assembly pivotally attached to the proximal end of the housing, a cover having substantially the same shape and configuration as the housing and pivotally attached to the proximal end, and a removable display device removably mounted on the support member and stored between the housing and the cover in a collapsed configuration. The collapsible tripod assembly further includes a plurality of leg extensions pivotally attached one to another and nestable within one another in a collapsed configuration to house within the housing.

BRIEF DESCRIPTION OF THE DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
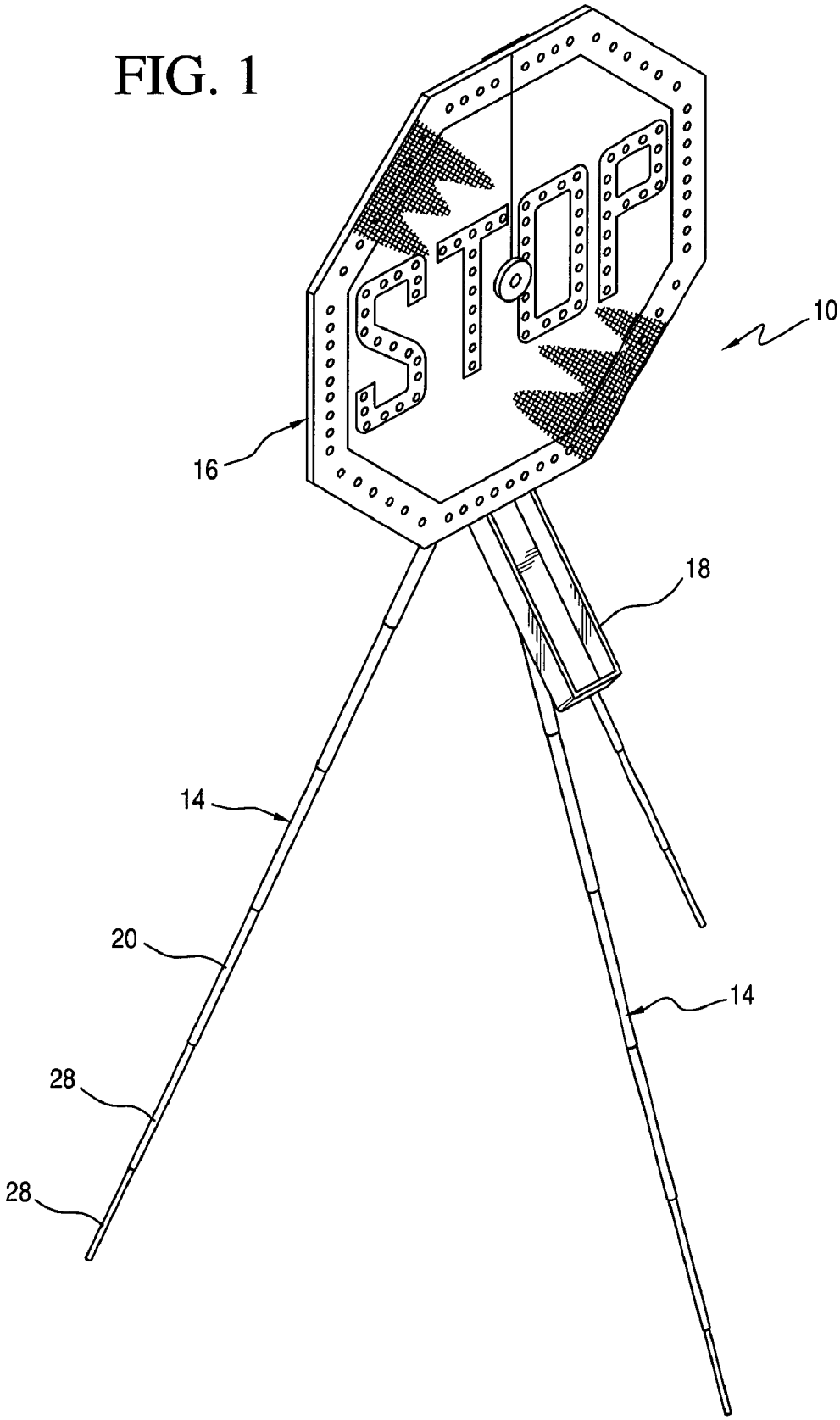
FIG. 1 is a perspective view of the portable multi-purpose sign and device in a deployed and upright position and configuration in accordance with a preferred embodiment of the present invention.

For the purpose of promoting and understanding of the principles of the invention, reference will now be made to the embodiments illustrated in the drawings. Referring now to the drawings, and more specifically to FIGS. 1 through 6, wherein the showings are for the purpose of illustrating the preferred embodiment of the invention only and not for the purpose of limiting the same, a portable multi-purpose sign and device is generally illustrated at 10 and includes a housing 12 having a substantially rectangular prism shape and configuration, although other shapes and configurations such as a cylinder are contemplated to be within the scope of the present invention, for securing and storing a collapsible tripod assembly 14 in a folded and collapsed configuration therewithin. The housing 12 supports a removable sign or device 16 at an upper and outer portion thereof, the details of which will be explained herein. A pivoting cover 18 having substantially the same rectangular prism shape and configuration as the housing 12 is pivotally attached at a lower end of the housing vertically opposing the removable sign and device 16, wherein the pivoting cover 18 pivots from a first closed position covering the removable sign and device 16 in a collapsed configuration as well as the tripod assembly 14 in a folded configuration substantially covering and aligning with the housing, to a second open position, as best seen in FIG. 2, pivoting in a clockwise direction, exposing the removable sign and device 16 and the tripod assembly 14 for use.

Figure 3:
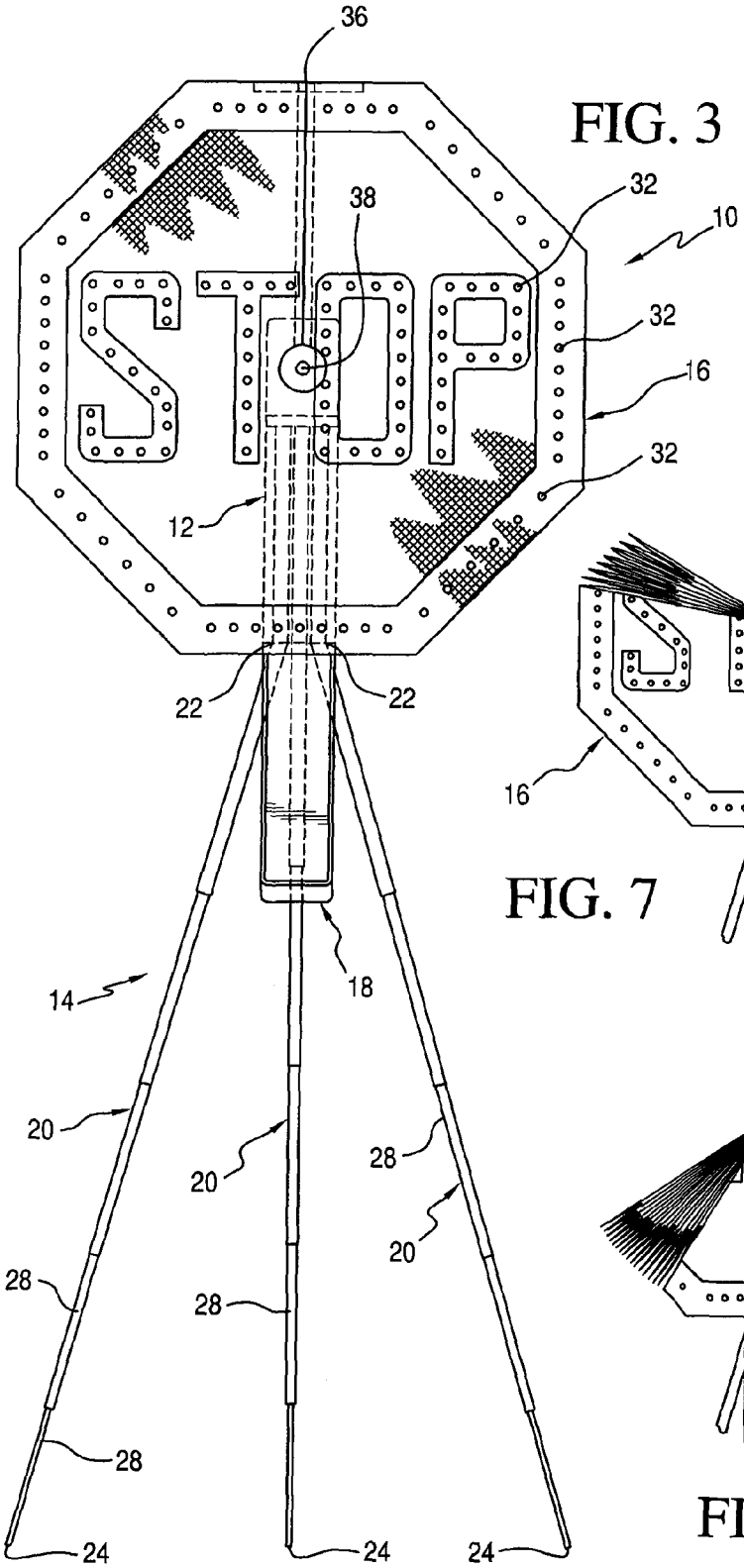
FIG. 3 is front plan view of the portable multi-purpose sign and device shown in FIG. 1.

The collapsible tripod assembly 14 includes three legs 20 made from suitable light-weight metal such as, but not limited to, aluminum, and forming a triangular pyramid in a deployed configuration, as best seen in FIG. 3. Each of the three legs 20 includes a proximal end 22 and a distal end 24, wherein the proximal ends 22 are pivotally attached to the lower end of the housing 12 and the pivoting cover 18 via a rivet 26 or similar securing means along a linear axis and substantially the width of the housing 12 and the pivoting cover 18, and the opposing distal ends 24 are supported on the ground or a support surface in a spaced apart triangular formation. Each of the three legs 20 further includes a plurality of leg extensions 28 pivotally connected to one another at their adjacent ends with a rivet or screw 30, and each leg extension 28 is preferably configured to have a rectangular prism channel-type shape and configuration.

Figure 5:
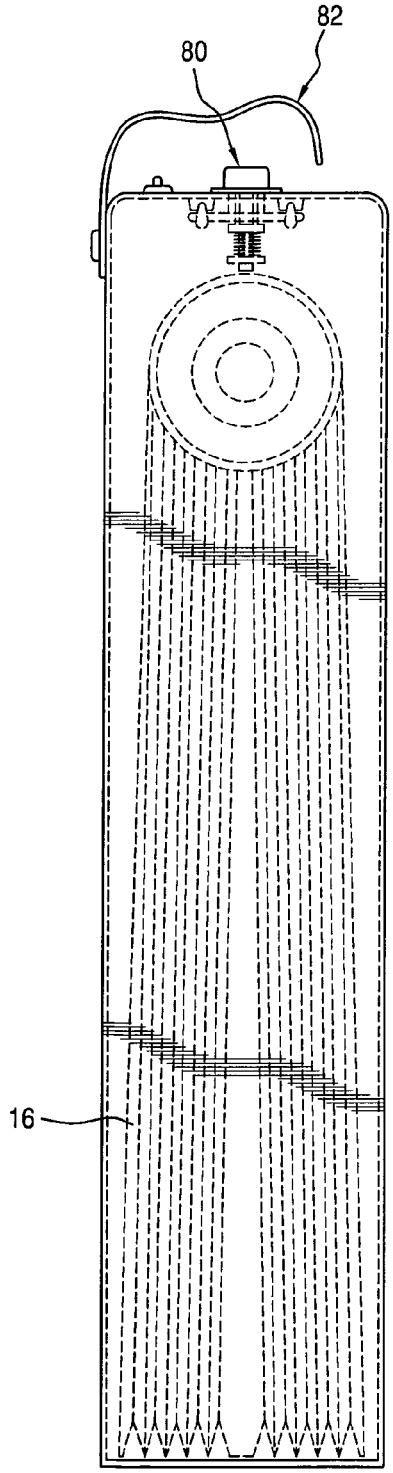
FIG. 5 is a side sectional view of the portable multi-purpose sign and device in a collapsed and stored configuration.
Figure 4:
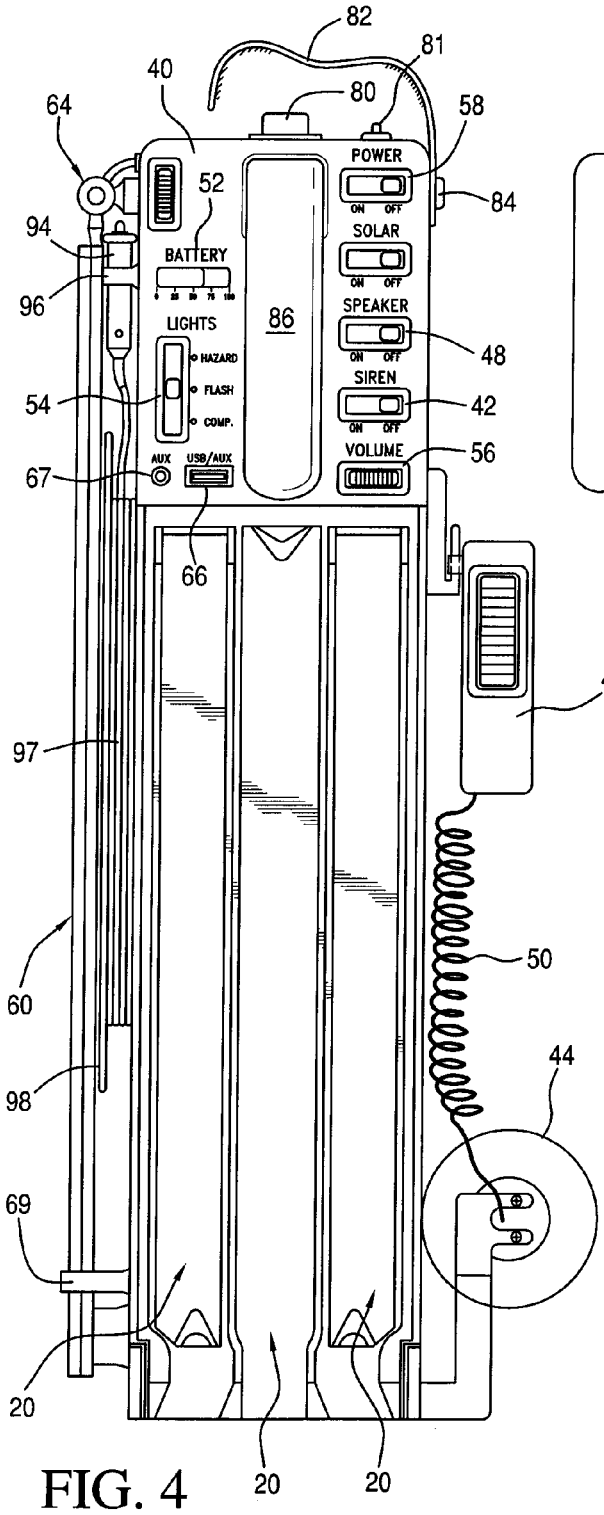
FIG. 4 is a back plan view of the portable multi-purpose sign and device in a collapsed and stored configuration.

As best seen in FIGS. 2 and 5, the preferred embodiment of the present invention contemplates the plurality of leg extensions 28 to have five leg extensions 28 having decreasing widths from the first of the plurality of leg extensions pivotally attached to the cover and housing, to the last of the plurality of leg extensions support on the ground to allow the lower positioned leg extension 28 to pivot and nest within the upper positioned and adjacent leg extension 28 for either completely folding the plurality of leg extensions for storage and carrying purposes, or folding a desired number of leg extensions to achieve the desired height for which the portable multi-purpose sign and device 10 to be supported on the ground. As best seen in FIG. 4, the completely folded and collapsed three legs 20 are then pivoted and positioned inside the housing 12 in a side-by-side manner for storage and carrying purposes.

Figure 2:
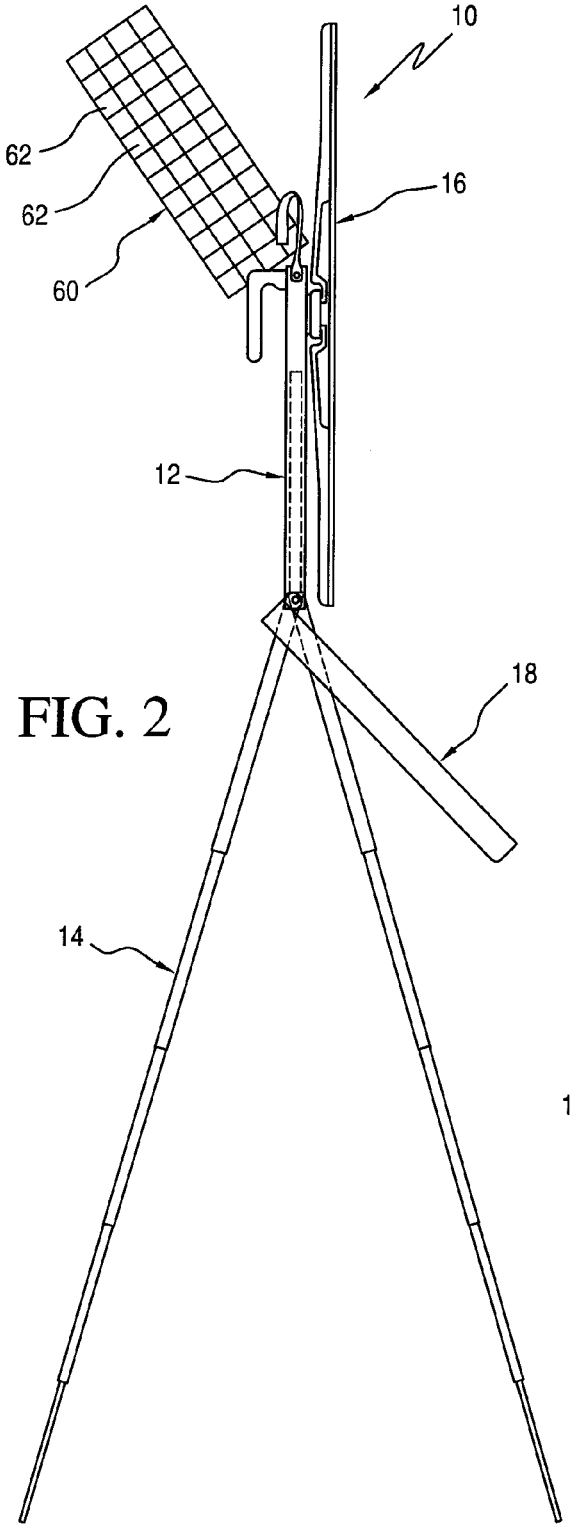
FIG. 2 is a side plan view of the portable multi-purpose sign and device shown in FIG. 1.
Figure 7:
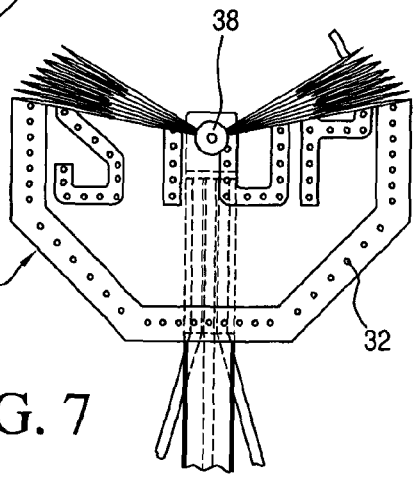
FIGS. 7 and 8 are plan views of the portable multi-purpose sign and device illustrating the sequence of folding the display sign into a closed and folded configuration.
Figure 8:
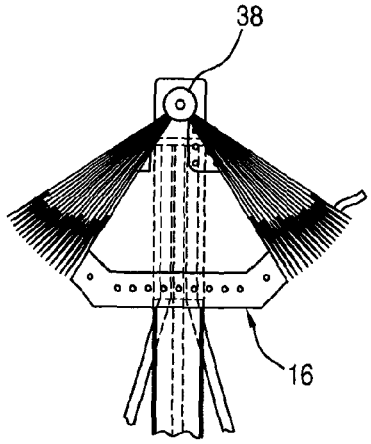

The removable sign or device 16 in the preferred embodiment illustrated in FIGS. 1 through 3 is made from a soft material such as, but not limited to, fabric, and is embedded with a plurality of Light Emitting Diodes (LED) 32 that are powered and turned on by various types of power source, as will be explained in greater detail herein. The LED's can remain constantly lit or can be configured to light up in a flashing manner. The removable sign 16 includes a slit 36 extending from an upper edge thereof to the center 38 of the sign 16 and, as best seen in FIGS. 7 and 8, is folded in and onto itself in an accordion manner and into a rectangular configuration having substantially the same width and height as the pivoting cover 18. When the removable sign 16 is completely folded from top to bottom, it can be enclosed within the pivoting cover 18 for storage and carrying purposes.

The portable multi-purpose sign and device 10 further includes a power source 40 such as, but not limited to, a rechargeable battery for lighting up the LED's 32 and other components of the portable multi-purpose sign and device 10, such as a siren operable by a siren ON/OFF switch 42, which siren has various alert outputs through a speaker 44. A microphone 46 is also contemplated to be connected to the speaker 44 via a coiled extension wire 50 to allow the operator to transmit various voice messages on site. The operator can simply switch between the use of the siren and the use of the microphone 46 through a speaker switch 48. A battery charge gauge 52 also provides how much charge remains in the battery, and alights switch 54 allows the operator to change between flash mode or constant ON mode for the LED's 32. A volume control switch 56 also adjusts the output volume of the speaker 44. A main ON/OFF power switch 58 turns all the components of the portable multi-purpose sign and device 10 ON or OFF. A USB/AUX outlet 66 also allows the operator to use the power source for operating other external components at the site, or charge other rechargeable external components such as a mobile phone. An AUX inlet 67 allows for connecting external devices, for example, but not limited to, an external microphone, to the portable multi-purpose sign and device for broadcasting through the speaker 44.

Alternatively or additionally, the various components may be powered by solar power through a pivoting solar cell 60 comprising a plurality of solar modules 62 that can convert the energy of sunlight directly into electricity for the various components or charge the battery during daylight. The pivoting solar cell 60 is attached to an upper side of the housing 12 with a ball-and-socket or other similar joint 64 to optimally adjust the orientation of pivoting solar cell 60 so that it can be in the direct path of sunlight, or to pivot in a stored position aligned with the side of the housing 12 and secured by a securing means such as a clip 69. Alternatively or additionally, the various components may be powered by directly by connecting the device to an electric outlet through an AC input 81, which can power various components of the portable multi-purpose sign and device, or recharge the battery.

Alternatively or additionally, the portable multi-purpose sign may be powered or recharged through and automobile cigarette lighter socket using a cigarette lighter adapter 94 operably attached to one end of an extension wire 97, the opposing end of which is connected to the battery. As best seen in FIG. 4, the extension wire 97 and cigarette lighter adapter 94 are in a stowed configuration, wherein the a holder 96 removably supports the adapter 94, and the extension wire 97 is wrapped around a second housing 98 secured to the side of the housing 12.

Figure 6:
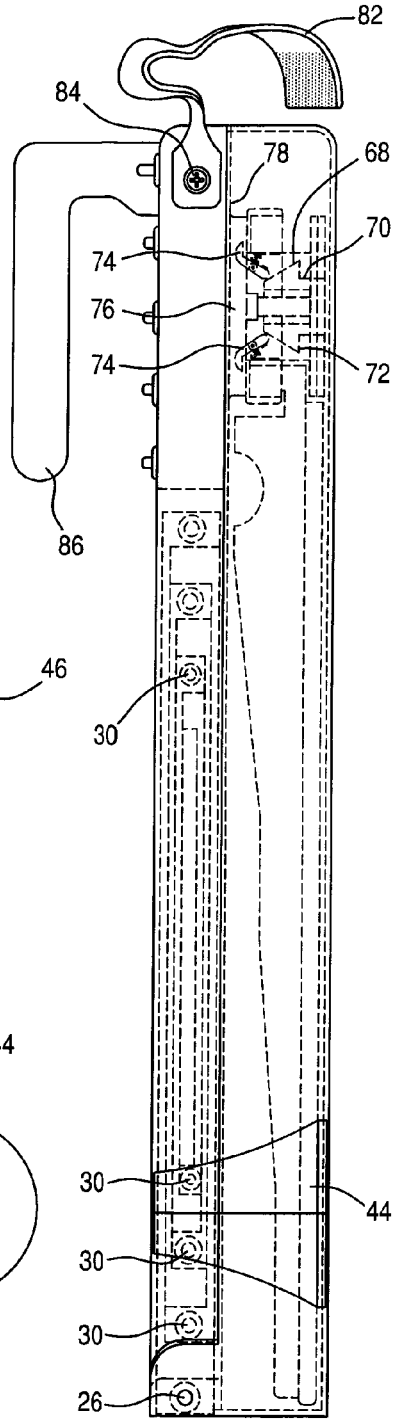
FIG. 6 is a side plan view of the portable multi-purpose sign and device in a collapsed and stored configuration.

Referring now more specifically to FIG. 6, the attaching means of the removable sign or device 16 is now explained. The removable sign or device 16 includes a frusto-conical member 68 having a rearwardly extending cylindrical portion 70 attached to the center 38 of the removable sign 16. The rearwardly extending cylindrical portion 70 has a diameter smaller than that of the frusto-conical member 68 thereby creating an engaging surface 72 at a wider end of the frusto-conical member 68. A support structure 76 is disposed and protrudes outwardly on an outer and upper side of the housing 12, and includes a pair of opposing anchor arms 74 pivotally disposed and spring biased in a spaced apart relation providing an opening therebetween for the frusto-conical member 68 to be inserted therethrough. As the frusto-conical member 68 is pushed through the opening to install the removable sign 16, the pair of opposing anchor arms 74 pivot about their spring biased pivot axis point and ultimately engage with the engaging surface 72 of the frusto-conical member 68 as the removable sign is installed on the support structure 76.

In order to detach and remove the removable sign 16 from the multi-purpose sign and device to use and attach other signs or devices for use, an unlatching mechanism comprising a slide member 78 and a spring biased button 80 located at a top surface of the housing 12 is used. The slide member 78 is pressed downwardly against the upper anchor arm 74 by the spring biased button 80, thereby disengaging the upper anchor arm 74 from the engaging the surface 72 of the frusto-conical member 68 and ultimately allowing the removal of the sign 16.

The portable multi-purpose sign an device 16 further includes a short strap 82 attached to an upper part of the housing 12 with a screw 84 or other suitable means, and an L-shaped handle 86 for carrying the portable multi-purpose sign and device 16. Alternatively, although not shown, a shoulder strap for carrying the portable multi-purpose sign and device is also contemplated to be within the scope of the present invention.

Figure 9:
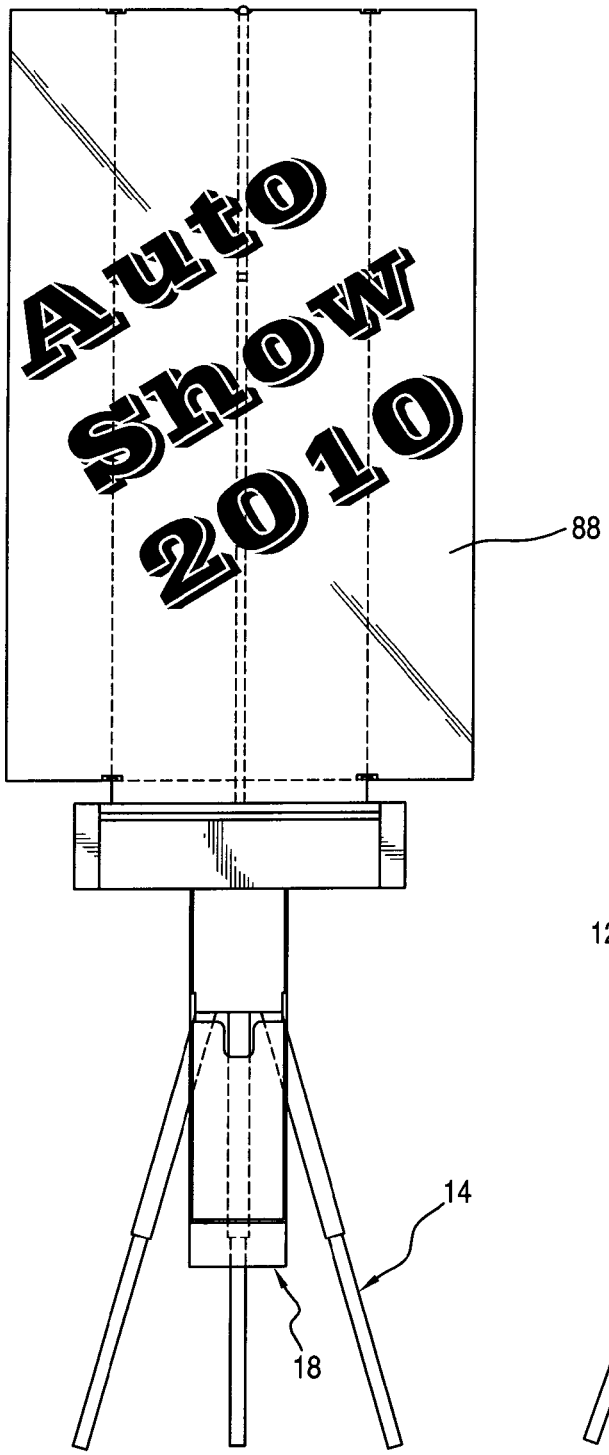
FIG. 9 is a front plan view of the portable multi-purpose sign and device in a deployed position and configuration in accordance with a second alternative embodiment of the present invention.
Figure 10:
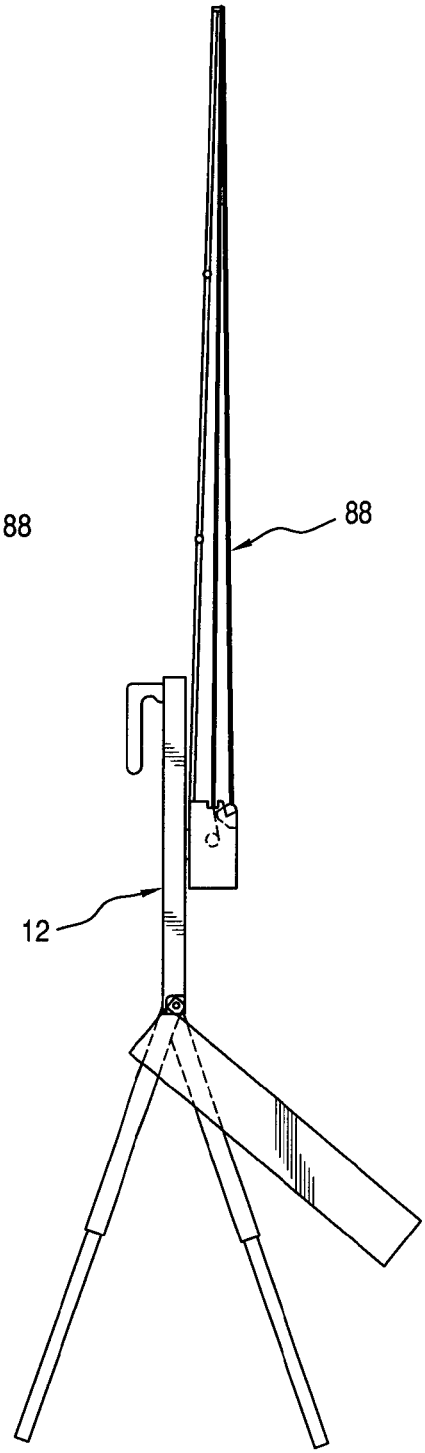
FIG. 10 is a side plan view of the portable multi-purpose sign and device shown in FIG. 9.

Referring now to FIGS. 9 and 10, a second alternative embodiment of the portable multi-purpose sign and device 10 is illustrated wherein the removable sign and device 16 is replaced with a rolling and retractable advertising banner 88. Other features and components of the portable multi-purpose sign and device 10 are identical to those features of the first preferred embodiment described hereinabove.

Figure 11:
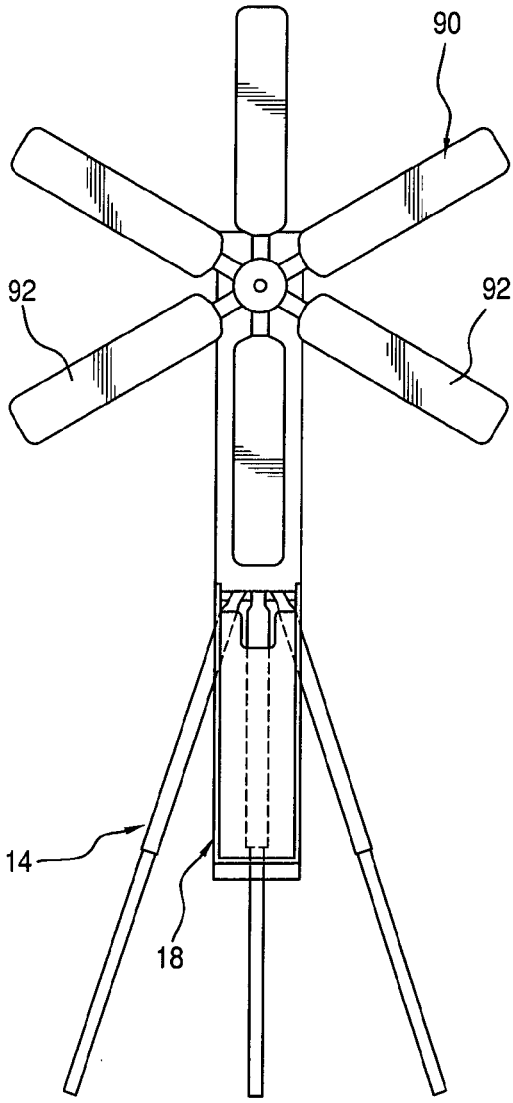
FIG. 11 is a front plan view of the portable multi-purpose sign and device in a deployed position and configuration in accordance with a third alternative embodiment of the present invention.
Figure 12:
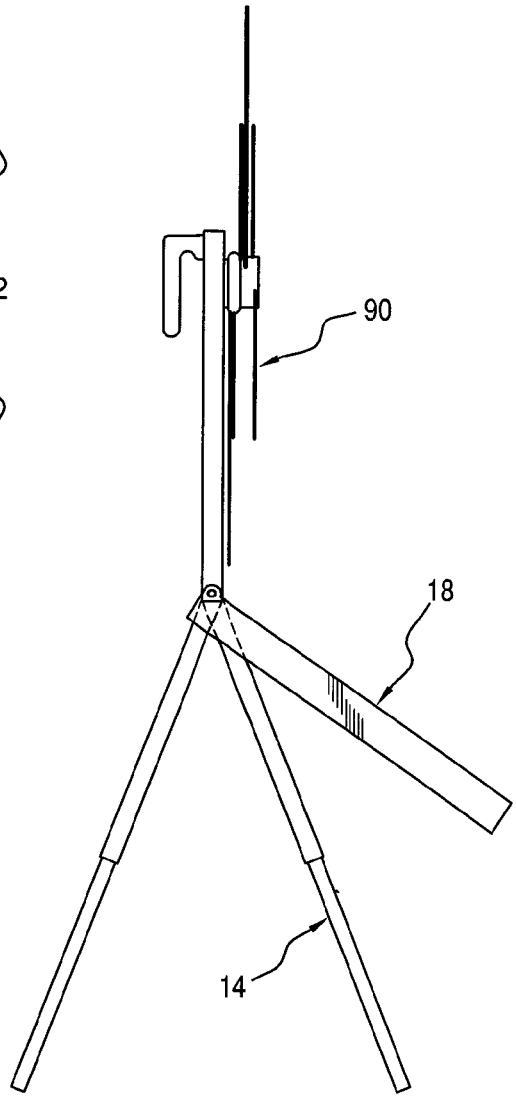
FIG. 12 is a side plan view of the portable multi-purpose sign and device shown in FIG. 11; and, FIGS. 13 through 23 are plan views of alternative devices and signs of various shapes and configurations that can be used with the portable multi-purpose sign and device.

Referring now to FIGS. 11 and 12, a third alternative embodiment of the portable multi-purpose sign and device is illustrated wherein the removable sign and device is replaced with an electric fan 90 comprising a plurality of fan blades 92, wherein the electric fan 90 is powered by the solar power source or battery power source.

Figure 13:
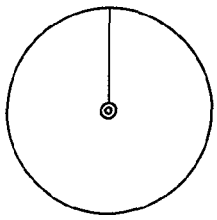
Figure 14:
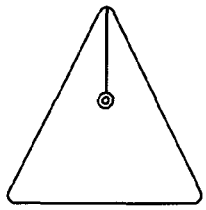
Figure 15:
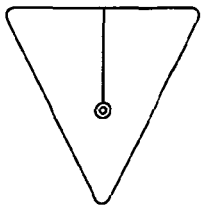
Figure 16:
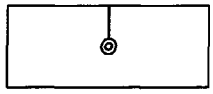
Figure 17:
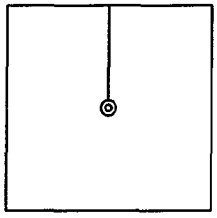
Figure 18:
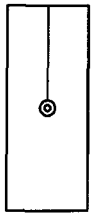
Figure 19:
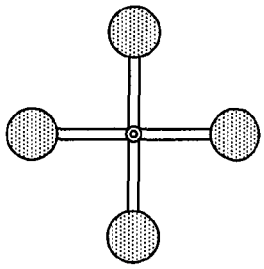
Figure 20:
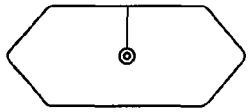
Figure 21:
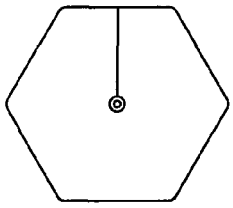
Figure 22:
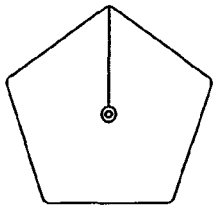
Figure 23:
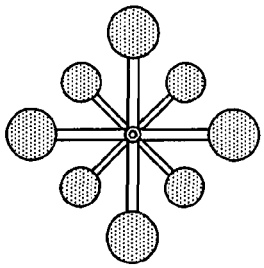

Referring now to FIGS. 13 through 23, other alternative embodiments of the removable sign and device contemplated to be within the scope of the present invention are illustrated. For example, FIG. 13 illustrates a circular sign, and FIG. 14 illustrates a triangular sign and display. It is noted that these alternative embodiments of the removable sign and device include the same frusto-conical member 68 for attaching the sign or device to the support structure 76 of the portable multi-purpose sign and device 10.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

What is claimed is:

1. A portable multi-purpose sign and device, comprising:

a housing having a proximal end and a distal end, and a support member disposed on one side thereof;

a collapsible tripod assembly pivotally attached to said proximal end of said housing;

a cover having substantially the same shape and configuration as said housing and pivotally attached to said proximal end;

a removable display device removably mounted to said support member and stored between said housing and said cover in a collapsed configuration;

said collapsible tripod assembly further comprising a plurality of leg extensions pivotally attached one to another and nestable within one another in a collapsed configuration to house within said housing;

wherein said collapsible tripod assembly and said removable display device can be stored within said housing and covered with said cover and be carried to a desired site; and wherein said removable display device further comprises a plurality of Light Emitting Diodes embedded within a display surface further comprising and a power source mounted in said housing.

2. The portable multi-purpose sign and device of claim 1, wherein said power source includes a solar cell comprising a plurality of solar modules.

3. The portable multi-purpose sign and device of claim 2, wherein said power source includes a rechargeable battery charged with said solar cell.

4. The portably multi-purpose sign and device of claim 3, further comprising a vehicle cigarette lighter adapter for connecting to a vehicle cigarette lighter socket for recharging said battery.

5. The portable multi-purpose sign and device of claim 1, further comprising a speaker, a siren, and a microphone disposed on said housing.

6. The portable multi-purpose sign and device of claim 1, wherein said removable display device includes a slit extending from an upper edge thereof to a central point thereof, and said removable display device is made of soft material allowing it to fold in an accordion manner to fit within said housing and said cover.

7. The portable multi-purpose sign and device of claim 6, wherein said removable display device includes a fursto-conical member attached to said central point thereof, said frusto-conical member is engageable with said support member.

8. A portable multi-purpose sign and device, comprising:

a housing having a proximal end and a distal end, and a support member disposed on one side thereof;

a collapsible tripod assembly pivotally attached to said proximal end of said housing;

a cover having substantially the same shape and configuration as said housing and pivotally attached to said proximal end;

a removable display device removably mounted to said support member and stored between said housing and said cover in a collapsed configuration;

said collapsible tripod assembly further comprising a plurality of leg extensions pivotally attached one to another and nestable within one another in a collapsed configuration to house within said housing;

wherein said collapsible tripod assembly and said removable display device can be stored within said housing and covered with said cover and be carried to a desired site; and a power source mounted in said housing.

* * * * *